US010962913B2

(12) United States Patent
Kawabata et al.

(10) Patent No.: US 10,962,913 B2
(45) Date of Patent: Mar. 30, 2021

(54) IMAGE FORMING APPARATUS, SHEET TYPE DETERMINATION METHOD AND PROGRAM IN THE APPARATUS

(71) Applicant: KONICA MINOLTA, INC., Tokyo (JP)

(72) Inventors: Mie Kawabata, Toyokawa (JP); Akira Murakawa, Toyonaka (JP); Atsushi Kawai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/923,262

(22) Filed: Jul. 8, 2020

(65) Prior Publication Data

US 2021/0048770 A1 Feb. 18, 2021

(30) Foreign Application Priority Data

Aug. 16, 2019 (JP) ..... JP2019-149330

(51) Int. Cl.
*G03G 15/00* (2006.01)

(52) U.S. Cl.
CPC ..... *G03G 15/5029* (2013.01); *G03G 15/6555* (2013.01)

(58) Field of Classification Search
CPC ..... G03G 15/5029; G03G 15/6555; G03G 15/6594; G03G 2215/00738; G03G 2215/00751
USPC ..... 399/38, 45
See application file for complete search history.

(56) References Cited

U.S. PATENT DOCUMENTS

| | | | | |
|---|---|---|---|---|
| 7,890,004 | B2 * | 2/2011 | Fujii | G03G 15/5029 399/45 |
| 8,238,771 | B2 * | 8/2012 | Murakami | G03G 15/6594 399/45 |
| 2009/0136246 | A1 * | 5/2009 | Murakami | G03G 15/5029 399/45 |
| 2020/0130971 | A1 | 4/2020 | Kawabata et al. | |

FOREIGN PATENT DOCUMENTS

JP 2016012069 A 1/2016

* cited by examiner

*Primary Examiner* — Hoan H Tran
(74) *Attorney, Agent, or Firm* — Holtz, Holtz & Volek PC

(57) ABSTRACT

An image forming apparatus includes: a sheet feeding tray that stores a sheet; a sheet thickness measurement device that measures a sheet thickness of the sheet fed from the sheet feeding tray; a hardware processor that: determines a type of the sheet of which the sheet thickness is measured, a sheet type associated with each of sheet thickness ranges, and the sheet thickness measured by the sheet thickness measurement device; and adjusts a first sheet thickness range by expanding the first sheet thickness range to at least one of an upper limit value side or a lower limit value side; and an image former that forms an image on the sheet fed from the sheet feeding tray under image forming conditions corresponding to the sheet type determined by the hardware processor.

22 Claims, 8 Drawing Sheets

FIG. 3

| SHEET FEEDING TRAY | SIZE | DIRECTION | SHEET THICKNESS ($g/m^2$) | SHEET TYPE |
|---|---|---|---|---|
| SHEET FEEDING CASSETTE 1 | A4 | LANDSCAPE | 63 | PLAIN SHEET |
| SHEET FEEDING CASSETTE 2 | A4 | PORTRAIT | UNSET | UNSET |
| SHEET FEEDING CASSETTE 3 | B4 | LANDSCAPE | 95 | THICK SHEET 1 |
| SHEET FEEDING CASSETTE 4 | B4 | PORTRAIT | 130 | THICK SHEET 2 |
| MANUAL SHEET FEEDING TRAY | A3 | LANDSCAPE | 85 | PLAIN SHEET |

FIG. 4

| SHEET THICKNESS ($g/m^2$) | SHEET TYPE |
|---|---|
| 52 TO 59 | THIN SHEET |
| 60 TO 90 | PLAIN SHEET |
| 91 TO 120 | THICK SHEET 1 |
| 121 TO 157 | THICK SHEET 2 |

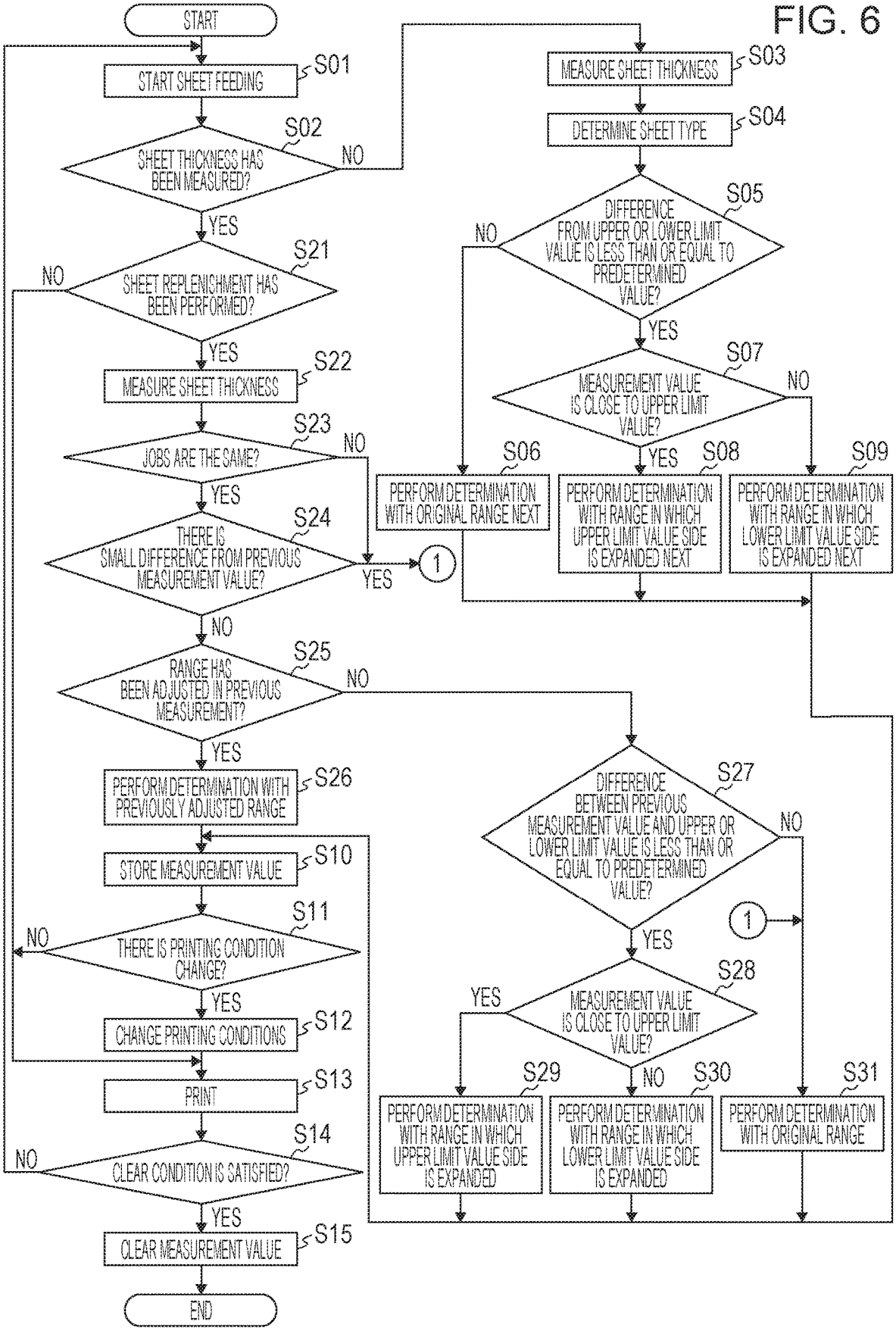
FIG. 6
START
START SHEET FEEDING
S01
SHEET THICKNESS HAS BEEN MEASURED?
S02
NO
YES
SHEET REPLENISHMENT HAS BEEN PERFORMED?
S21
NO
YES
MEASURE SHEET THICKNESS
S22
JOBS ARE THE SAME?
S23
NO
YES
THERE IS SMALL DIFFERENCE FROM PREVIOUS MEASUREMENT VALUE?
S24
YES
1
NO
RANGE HAS BEEN ADJUSTED IN PREVIOUS MEASUREMENT?
S25
NO
YES
PERFORM DETERMINATION WITH PREVIOUSLY ADJUSTED RANGE
S26
STORE MEASUREMENT VALUE
S10
THERE IS PRINTING CONDITION CHANGE?
S11
NO
YES
CHANGE PRINTING CONDITIONS
S12
PRINT
S13
CLEAR CONDITION IS SATISFIED?
S14
NO
YES
CLEAR MEASUREMENT VALUE
S15
END
MEASURE SHEET THICKNESS
S03
DETERMINE SHEET TYPE
S04
DIFFERENCE FROM UPPER OR LOWER LIMIT VALUE IS LESS THAN OR EQUAL TO PREDETERMINED VALUE?
S05
NO
YES
MEASUREMENT VALUE IS CLOSE TO UPPER LIMIT VALUE?
S07
NO
YES
PERFORM DETERMINATION WITH ORIGINAL RANGE NEXT
S06
PERFORM DETERMINATION WITH RANGE IN WHICH UPPER LIMIT VALUE SIDE IS EXPANDED NEXT
S08
PERFORM DETERMINATION WITH RANGE IN WHICH LOWER LIMIT VALUE SIDE IS EXPANDED NEXT
S09
DIFFERENCE BETWEEN PREVIOUS MEASUREMENT VALUE AND UPPER OR LOWER LIMIT VALUE IS LESS THAN OR EQUAL TO PREDETERMINED VALUE?
S27
NO
1
YES
MEASUREMENT VALUE IS CLOSE TO UPPER LIMIT VALUE?
S28
YES
NO
PERFORM DETERMINATION WITH RANGE IN WHICH UPPER LIMIT VALUE SIDE IS EXPANDED
S29
PERFORM DETERMINATION WITH RANGE IN WHICH LOWER LIMIT VALUE SIDE IS EXPANDED
S30
PERFORM DETERMINATION WITH ORIGINAL RANGE
S31

IMAGE FORMING APPARATUS, SHEET TYPE DETERMINATION METHOD AND PROGRAM IN THE APPARATUS

The entire disclosure of Japanese patent Application No. 2019-149330, filed on Aug. 16, 2019, is incorporated herein by reference in its entirety.

BACKGROUND

Technological Field

The present invention relates to an image forming apparatus such as a copying machine, a printer, or a Multifunction Peripheral (MFP) that is a multifunction digital combined machine, a sheet type determination method and a program executed by the apparatus.

Description of the Related Art

In a recent image forming apparatus as described above, by processing a sheet conveyance speed and the like with an appropriate value depending on a type of a sheet on which an image is printed, image quality of a print result is improved, and troubles are avoided such as a sheet jam and the like. Thus, to appropriately execute printing by the image forming apparatus, it is necessary that the type of the sheet stored in a sheet feeding tray is correctly set.

However, it is difficult for a user to determine the sheet type, and when the sheet is set in the sheet feeding tray, a wrong sheet type is set, which may cause a trouble such as a jam.

Thus, the above-described problem is solved by providing a sheet type determination unit in which a sheet thickness of a sheet fed from the sheet feeding tray is measured, the sheet type is set for each predetermined sheet thickness range, and the sheet type is automatically determined on the basis of the measured sheet thickness, and by performing print processing with optimum parameters in accordance with the sheet type determined by the sheet type determination unit.

In a conventional image forming apparatus including such a sheet type determination unit based on sheet thickness measurement, for example, in a case where a user uses a sheet having a sheet thickness near a threshold value (upper limit value or lower limit value) that defines a sheet thickness range, and replenishes sheets of the same type when the sheet runs out during printing, the thickness of the sheet is measured again; however, there is a possibility that it is determined that sheets having different thickness, in other words, sheets of a different type are replenished, depending on a sheet feeding position, sheet quality and water content, measurement timing, or the like. In this case, a problem occurs that print control is changed and the start of the print processing is delayed.

To solve such a problem, in JP 2016-12069 A, an image forming apparatus is devised in which sheets in a range in which several predetermined widths (grids) of sheet thickness are collected are treated as a specific sheet type, whereby even if the sheet thickness of a sheet measured in the middle of a job is different from the initial sheet thickness due to the sheet feeding position, sheet quality and water content, measurement timing, or the like, a possibility is increased that the measured sheet is determined as the sheet of the same type, and switching of the print control in the middle of the same job is prevented.

Specifically, when a sheet thickness in a range of 80 to 89 μm (circled number 1 in FIG. 9A) is measured by the first sheet thickness measurement in a state where the grid is 10 μm, and a sheet type A is set for a range of sheet thickness 79 μm or less and sheet thickness 80 to 89 μm, and a sheet type B is set for a range of sheet thickness 90 to 99 μm and sheet thickness 100 to 109 μm, the range in which the sheet type is determined as the sheet type A is expanded to sheet thickness 90 to 99 μm that is an amount of one grid, in the second sheet thickness measurement after the sheet replenishment, for example, as illustrated in FIG. 9B. In other words, in the second sheet thickness measurement, the sheet type is determined as the sheet type A in a range of 80 to 99 μm. Thus, even though the sheet thickness of the range of 80 to 89 μm should be originally measured at the time of the second sheet thickness measurement since the sheets before and after the replenishment are sheets of the same type, the sheet type is determined as A even if the sheet thickness in the range of 90 to 99 μm (circled number 2 in FIG. 9B) is measured due to the sheet feeding position, sheet quality and water content, measurement timing, or the like. As a result, it is possible to prevent switching of the print control in the middle of the same job.

However, the image forming apparatus described in JP 2016-12069 A has the following problem. That is, the sheet thickness range 80 to 89 μm in which the sheet type is determined as the sheet type A by the first sheet thickness measurement is expanded to 80 to 99 μm by the second sheet thickness measurement, so that, for example, as illustrated in FIG. 9C, in a case where a sheet thickness of a value slightly exceeding 80 p (circled number 1 in FIG. 9C) is measured by the first sheet thickness measurement, and a sheet thickness of a value slightly below 99 μm (circled number 2 in FIG. 9C) is measured by the second sheet thickness measurement, the sheet types are determined as the same sheet type A even though there is a sheet thickness difference of approximately two grids (20 μm).

However, in a normal sheet, for example, a plain sheet with a sheet thickness of 80 to 100 μm, a variation near 20% is not caused in the sheet thickness measurement value, and it can be determined that the sheet of the first measurement value and the sheet of the second measurement value are obviously the sheets of different types.

As described above, in the image forming apparatus described in JP 2016-12069 A, there has been a problem that the sheet types are determined as the same sheet type even though the sheet types are actually different from each other.

SUMMARY

The present invention has been made in view of such a technical background, and an object thereof is to provide an image forming apparatus that determines a sheet type by measuring a sheet thickness, and that can suppress occurrence of an erroneous determination that sheet types are determined as the same sheet type even though a sheet type based on the first sheet thickness measurement and a sheet type based on the second sheet thickness measurement in the same job are different from each other, and a sheet type determination method and program in the image forming apparatus.

To achieve the abovementioned object, according to an aspect of the present invention, an image forming apparatus reflecting one aspect of the present invention comprises: a sheet feeding tray that stores a sheet; a sheet thickness measurement device that measures a sheet thickness of the sheet fed from the sheet feeding tray, a hardware processor that: determines a type of the sheet of which the sheet thickness is measured, on a basis of a plurality of sheet thickness ranges set in advance, a sheet type associated with each of the sheet thickness ranges, and the sheet thickness measured by the sheet thickness measurement device; and adjusts a first sheet thickness range by expanding the first sheet thickness range to at least one of an upper limit value side or a lower limit value side, in a case where a second sheet thickness measurement is performed by the sheet thickness measurement device after a first sheet thickness measurement by the sheet thickness measurement device in an identical job, by performing at least one of processing of adding a predetermined amount of adjustment to an upper limit value of the first sheet thickness range including a first sheet thickness measured by the first sheet thickness measurement to obtain an adjusted upper limit value, or processing of subtracting a predetermined amount of adjustment from a lower limit value of the first sheet thickness range to obtain an adjusted lower limit value; and an image former that forms an image on the sheet fed from the sheet feeding tray under image forming conditions corresponding to the sheet type determined by the hardware processor, wherein the hardware processor determines the type of the sheet on which the second sheet thickness measurement is performed, by applying an adjusted sheet thickness range by the hardware processor instead of the first sheet thickness range.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3 is a diagram illustrating an example of sheet feeding tray information;

FIG. 4 is a diagram illustrating an example of a sheet type determination table;

FIG. 6 is a flowchart illustrating sheet type determination processing executed by the image forming apparatus;

DETAILED DESCRIPTION OF EMBODIMENTS

Hereinafter, one or more embodiments of the present invention will be described with reference to the drawings. However, the scope of the invention is not limited to the disclosed embodiments.

Figure 1:
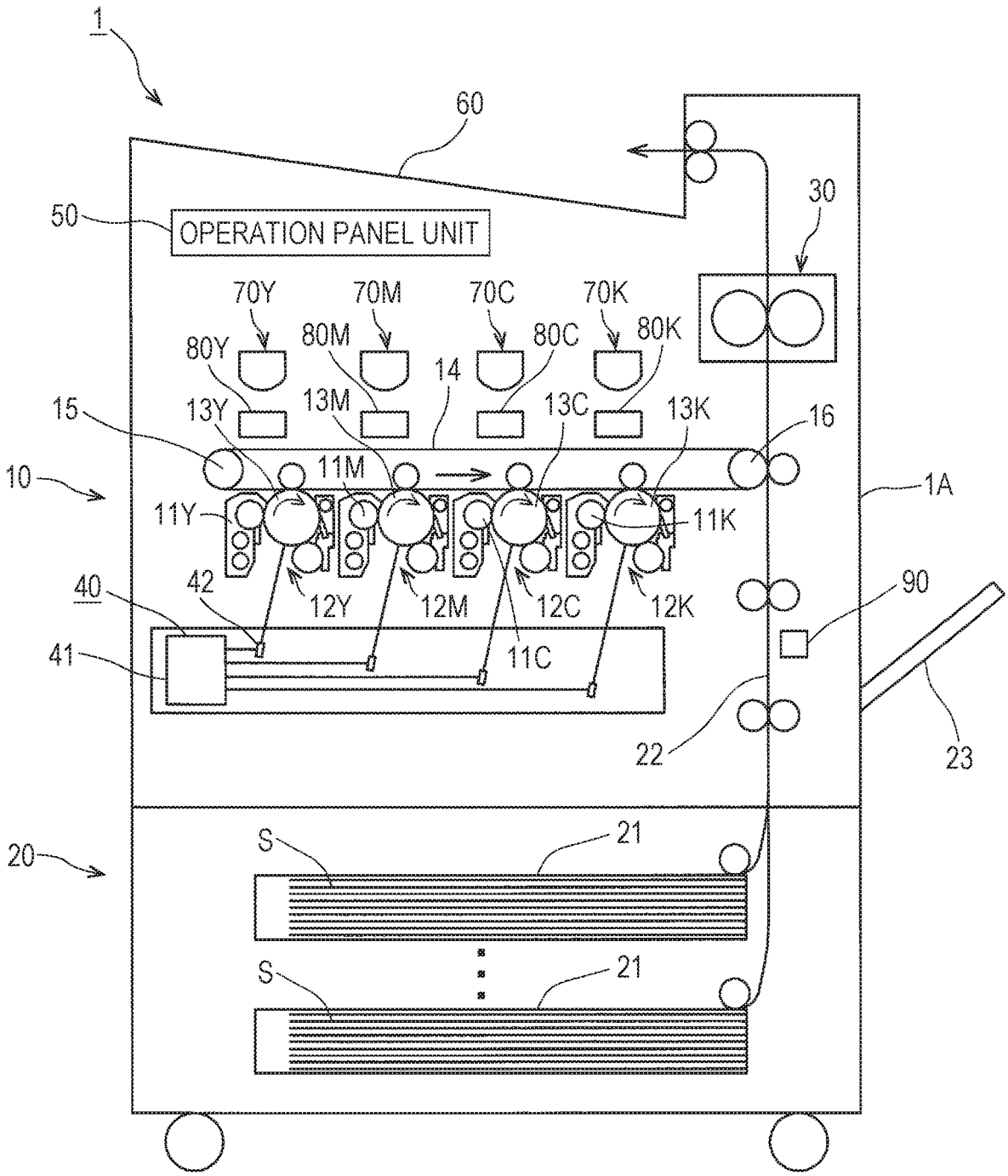
FIG. 1 is a schematic configuration diagram of an image forming apparatus according to an embodiment of the present invention.

FIG. 1 is a schematic configuration diagram of an image forming apparatus 1 according to an embodiment of the present invention. In this example, a tandem type color printer is used as the image forming apparatus 1.

In FIG. 1, the image forming apparatus 1 includes a sheet feeding unit 20 arranged in a lower part of an apparatus main body 1A, an image forming unit 10 arranged in a central part, and a sheet ejection unit 60 arranged in an upper part. The sheet feeding unit 20 is provided with a plurality of sheet feeding cassettes 21 as sheet feeding trays, and from each of the sheet feeding cassettes 21 to the sheet ejection unit 60, a sheet conveyance path 22 is formed that conveys upward a sheet S fed from the sheet feeding cassettes 21. Note that, the sheet S is not limited to one made of paper, but means a medium on which an image is formed. Moreover, a manual sheet feeding tray 23 is provided on a side surface of the image forming apparatus 1, and the sheet S fed from the manual sheet feeding tray 23 is also joined to the sheet conveyance path 22 and conveyed.

Furthermore, on the downstream side of each of the sheet feeding cassettes 21 and the manual sheet feeding tray 23, a sheet thickness detection sensor 90 for measuring the sheet thickness that is the thickness of the sheet S is provided near the sheet conveyance path 22, and on the basis of a signal of the sheet thickness detection sensor 90, the sheet thickness of the sheet S fed from the sheet feeding cassettes 21 or the manual sheet feeding tray 23 can be measured. The type of the sheet thickness detection sensor 90 is not limited.

Furthermore, in this embodiment, for example, the sheet thickness may be indicated in a unit of thickness such as μm, or may be indicated in a unit of basis weight ($g/m^2$) or the like. Thus, the sheet thickness detection sensor 90 may be a sensor that detects the basis weight of the sheet S. Since a sheet thickness measurement technology using the sheet thickness detection sensor 90 is known, detailed description thereof will be omitted.

The image forming unit 10 includes a drive roller 16 and a driven roller 15 arranged at substantially the center in the vertical direction of the apparatus main body 1A, an intermediate transfer belt 14 that is horizontally hung between the drive and driven rollers 16 and 15 and travels in the arrow direction, and photoreceptor units 12Y, 12M, 12C, and 12K that are image formation units for respective colors of yellow (Y), magenta (M), cyan (C), and black (K) arranged along the traveling direction.

Toner images created by the photoreceptor units 12Y, 12M, 12C, and 12K are superimposed and transferred onto the transfer belt 14, secondary transfer is performed at the conveyance end (right end in the figure) of the transfer belt 14 to the sheet S conveyed through the sheet conveyance path 22, and the sheet S is fed to a fixing unit 30 and the toner image is fixed.

The photoreceptor units 12Y, 12M, 12C, and 12K respectively form images by an electrostatic copying method, and include charging devices, developing devices 11Y, 11M, 11C, and 11K, photoreceptor drums 13Y, 13M, 13C, and 13K, transfer devices, and the like arranged around the photoreceptor units. Furthermore, surfaces of the photoreceptor drums 13Y, 13M, 13C, and 13K charged by the charging devices are exposed by four laser diodes of an exposing unit 40 including a print head 41 having the diodes, a polygon mirror, a scanning lens, and the like, four reflection mirrors 42, and the like, and an electrostatic latent image is formed on the surfaces.

Furthermore, as a replenishing mechanism that replenishes toner to the developing devices 11Y, 11M, 11C, and 11K of the respective photoreceptor units 12Y, 12M, 12C, and 12K, toner cartridges 70Y, 70M, 70C, and 70K and sub-hoppers 80Y, 80M, 80C, and 80K are arranged at positions above the photoreceptor units 12Y, 12M, 12C, and 12K.

Note that, in FIG. 1, an operation panel unit 50 includes a key unit and a display unit.

Figure 2:
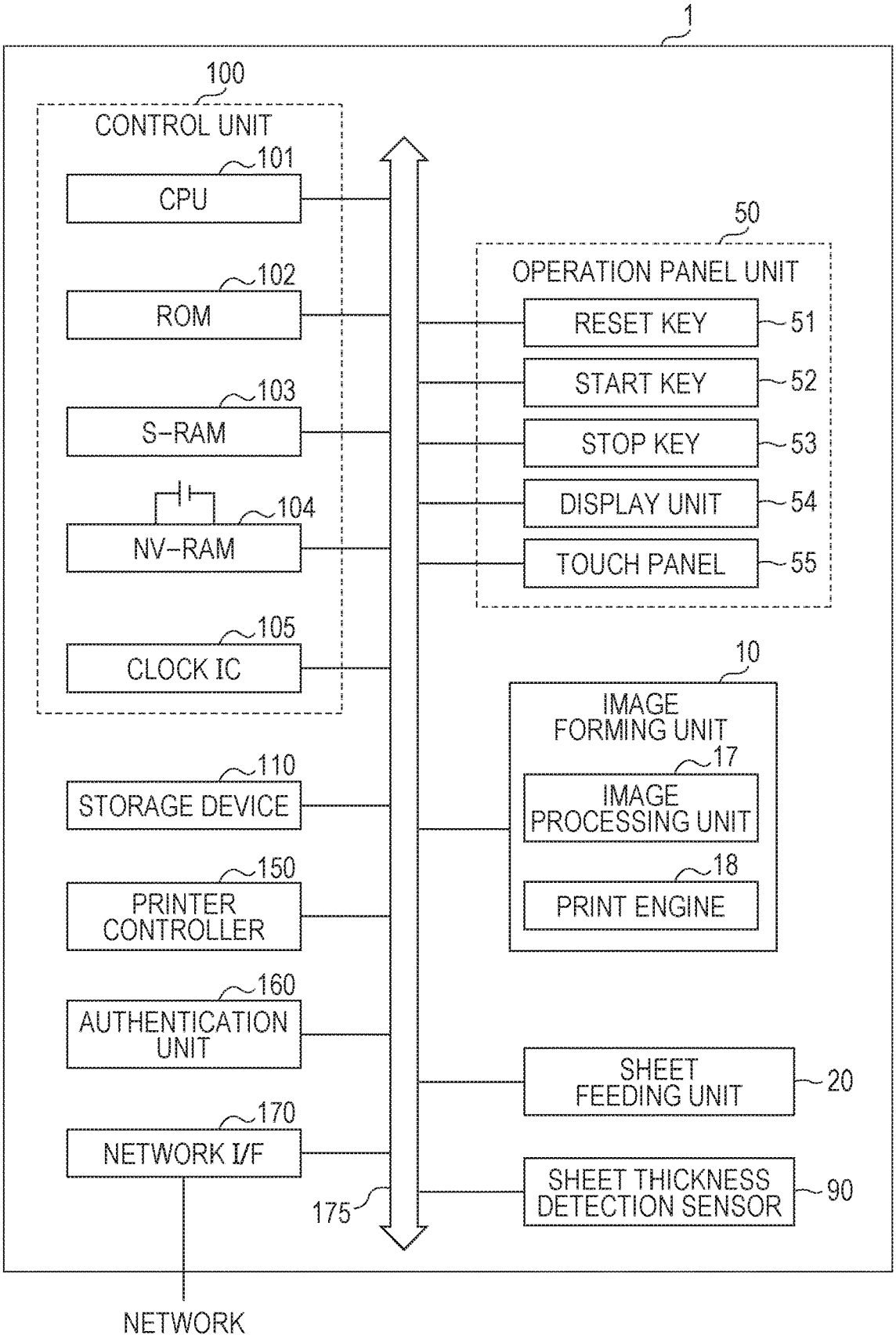
FIG. 2 is a block diagram illustrating an electrical configuration of the image forming apparatus.

FIG. 2 is a block diagram illustrating an electrical configuration of the image forming apparatus 1. As illustrated in FIG. 2, the image forming apparatus 1 includes a control unit 100, a storage device 110, and also the above-described operation panel unit 50, the image forming unit 10, the sheet feeding unit 20, the sheet thickness detection sensor 90, and further, a printer controller 150, an authentication unit 160, a network interface (network I/F) 170, and the like, and the units are connected to each other via a system bus 175.

The control unit 100 includes a Central Processing Unit (CPU) 101, a Read Only Memory (ROM) 102, a Static Random Access Memory (S-RAM) 103, a Non Volatile RAM (NV-RAM) 104, a clock IC 105, and the like.

The CPU 101 comprehensively controls the entire image forming apparatus 1 by executing an operation program stored in the ROM 102 or the like. For example, a printer function and the like are controlled to be executable, and in particular in this embodiment, during printing, the sheet thickness of the sheet S is measured on the basis of a signal from the sheet thickness detection sensor 90, and also the type of the sheet S is determined on the basis of the measurement result, and image forming conditions (printing conditions) corresponding to the determined sheet type are automatically set, and printing is executed. Moreover, control is performed such as measuring the sheet thickness of the sheet S to determine the sheet type when the sheet is replenished due to running out of the sheet of the sheet feeding cassette 21, and the like, which will be described later in detail.

The ROM 102 stores programs executed by the CPU 101 and other data.

The S-RAM 103 is a work area when the CPU 101 executes a program, and temporarily stores the program, data when the program is executed, and the like.

The NV-RAM 104 is a nonvolatile memory backed up by a battery, and stores various settings related to image formation, the number of pixels of a display unit 54, data of various screens displayed on the display unit 54, and the like.

The clock IC 105 measures the time and functions as an internal timer to perform processing time measurement and the like.

The storage device 110 includes a hard disk or the like, and stores programs, various data, and the like. In particular in this embodiment, sheet feeding tray information that is information on the sheet stored in the sheet feeding cassette 21 or the manual sheet feeding tray 23, and further a table that associates a sheet thickness range of the sheet with the sheet type, and the like are stored.

The operation panel unit 50 is used when a user gives an instruction for a job or the like to the image forming apparatus 1 or makes various settings, and includes a reset key 51, a start key 52, a stop key 53, the display unit 54, a touch panel 55, and the like.

The reset key 51 is used when resetting the settings, the start key 52 is used for a start operation for scanning or the like, and the stop key 53 is pressed when the operation is suspended, or the like.

The display unit 54 includes, for example, a liquid crystal display device, and displays a message, various operation screens, and the like, and the touch panel 55 is formed on the screen of the display unit 54 and measures touch operation of the user.

The image forming unit 10 prints on a sheet a copy image generated from print data transmitted from an external device, and includes an image processing unit 17, a print engine 18, and the like.

The image processing unit 17 performs image processing on print target data in accordance with a set image processing mode. Furthermore, the print engine 18 refers to a hardware part related to image formation, for example, the photoreceptor units 12Y, 12M, 12C, and 12K, the developing devices 11Y, 11M, 11C, and 11K, the photoreceptor drums 13Y, 13M, 13C, and 13K, the charging devices, the transfer devices, the laser diodes, the polygon mirror, the print head 41, and motors that drive these.

As described above, the sheet feeding unit 20 includes the sheet feeding cassette 21, the manual sheet feeding tray 23, and the like.

The printer controller 150 generates a copy image from the print data received by the network interface 170.

The authentication unit 160 acquires authentication information of the user who logs in, and performs authentication by comparing and collating the authentication information with verification information stored in advance in the storage device 110 or the like. Note that, comparing and collating the authentication information of the user with the verification information may be performed by an external authentication server, and authentication may be performed by the authentication unit 160 receiving the authentication result from the authentication server.

The network interface 170 functions as a communication unit that transmits/receives data to/from an external terminal device or the like.

As described above, the sheet thickness detection sensor 90 is a sensor used for sheet thickness measurement for the sheet S.

Next, a description will be given of the operation during printing of the image forming apparatus 1 illustrated in FIGS. 1 and 2.

In this embodiment, the sheet feeding tray information indicating the size, direction (orientation), sheet thickness, and sheet type of the sheet S stored in each of the sheet feeding cassette 21 and the manual sheet feeding tray 23 is stored in the storage device 110. An example of the sheet feeding tray information is illustrated in FIG. 3.

In the example of FIG. 3, it is illustrated that as the sheet feeding trays of the image forming apparatus 1, four sheet feeding cassettes 21 (respectively denoted as sheet feeding cassettes 1 to 4 in FIG. 3) and one manual sheet feeding tray 23 are provided; the sheet cassette 1 stores a sheet having the size: A4, direction: landscape, sheet thickness (basis weight): 63 g/m$^2$, and sheet type: plain sheet; the sheet cassette 2 stores a sheet having the size: A4, direction: portrait, sheet thickness (basis weight): unset, and sheet type: unset; the sheet cassette 3 stores a sheet having the size: B4, direction: landscape, sheet thickness (basis weight): 95 g/m$^2$, and sheet type: thick sheet 1; the sheet cassette 4 stores a sheet having the size: B4, direction: portrait, sheet thickness (basis weight): 130 g/m$^2$, and sheet type: thick sheet 2; and the manual sheet feed tray stores a sheet having the size: A3, direction: landscape, sheet thickness (basis weight): 85 g/m$^2$, and sheet type: plain sheet.

In the sheet feeding tray information illustrated in FIG. 3, the sheet size and direction may be set by the user by inputting setting values from the operation panel unit 50, or may be automatically measured and set by the image forming apparatus 1 on the basis of the sheet feeding cassette, the size regulation plate of the manual sheet feeding tray, or the like.

In the sheet feeding tray information of FIG. 3, the sheet thickness (basis weight) is a sheet thickness measurement result using the sheet thickness detection sensor 90, and the sheet type is determined on the basis of the sheet thickness measurement result. In other words, a sheet type determination table indicating a relationship between the sheet type and the sheet thickness is stored in advance in the storage device 110, and the sheet thickness measurement result by the sheet thickness detection sensor 90 is collated with the sheet type determination table, whereby the sheet type corresponding to the measured sheet thickness is determined as the sheet type of the sheet S whose sheet thickness is measured. Note that, "unset" in the sheet feeding cassette 2 indicates that the sheet thickness measurement and the sheet type determination has not been performed.

An example of the sheet type determination table is illustrated in FIG. 4. In the example of FIG. 4, a thin sheet is associated with a range of sheet thickness (basis weight) 52 to 59 g/m$^2$, the plain sheet is associated with a range of sheet thickness 60 to 90 g/m$^2$, the thick sheet 1 is associated with a range of sheet thickness 91 to 120 g/m$^2$, and the thick sheet 2 is associated with a range of sheet thickness 121 to 157 g/m$^2$. Thus, if the measured sheet thickness is in the range of 60 to 90 g/m$^2$, the sheet type is determined as the plain sheet.

Such sheet type determination is performed on the basis of the sheet thickness measurement for the sheet S first fed in the job, in other words, a result of the first sheet thickness measurement, and the sheet thickness measurement result and the determined sheet type are overwritten on respective items of the sheet thickness and the sheet type in the sheet feeding tray information illustrated in FIG. 3. However, for the sheet feeding cassettes or the manual sheet feeding tray for which the sheet S is not replenished after the end of the previous job, the sheet thickness written in the sheet feeding tray information may be regarded as the first sheet thickness measurement result, and the sheet type written in the sheet feeding tray information may be regarded as the sheet type determined on the basis of the sheet thickness measurement result.

In this way, when the sheet type is determined by the first sheet thickness measurement for the sheet S fed from the sheet feeding cassette 21 or the manual sheet feeding tray 23, or the sheet type is determined by being regarded as the first sheet measurement, at the start of the job, image formation is performed under an optimum image forming conditions for the determined sheet type. Although illustration is omitted, since appropriate values of the image forming conditions such as printing speed differ depending on respective sheet types, the sheet type and the image forming conditions are associated with each other in advance. Image formation is performed under the same image forming conditions until the sheet S runs out.

Next, when the sheet runs out during execution of the same job, a new sheet S is replenished by the user to the sheet feeding cassette 21 or the manual sheet feeding tray 23 in which the sheet runs out.

Then, the replenishment of the sheet S is detected by a sensor (not illustrated) or the like, and when the replenished sheet S is fed, the second sheet thickness measurement is executed on the replenished sheet S by the sheet thickness detection sensor 90.

However, even if the sheets S before and after replenishment are sheets of the same sheet type, depending on the sheet feeding position, sheet quality and water content, measurement timing, or the like, the sheet thickness of the sheet S before replenishment, in other words, a first sheet thickness b1 by the first sheet thickness measurement and the sheet thickness of the sheet S after replenishment, in other words, a second sheet thickness b2 by the second sheet thickness measurement do not necessarily have the same values or approximate values, and variation occurs in the measurement values. Thus, depending on the values of the first sheet thickness bland the second sheet thickness b2, there is a possibility that the sheet types are determined as different sheet types as described below.

Figure 5A:
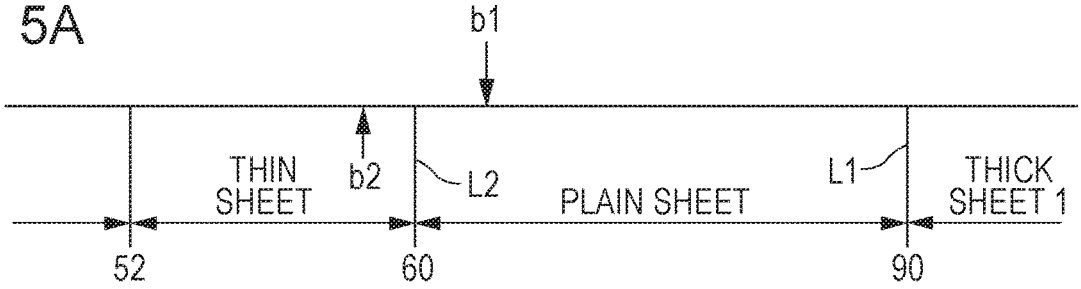
FIGS. 5A to 5D are diagrams for explaining an example of a sheet thickness range adjustment method.

That is, as illustrated in FIG. 5A, in a case where the first sheet thickness b1 is, for example, 63 g/m$^2$, and is determined as the sheet thickness of the plain sheet, if the second sheet thickness b2 is 58 g/m$^2$, from the sheet type determination table in FIG. 4, the replenished sheet S is determined as the thin sheet, which is different from the plain sheet that is the sheet type before replenishment. Note that, in FIGS. 5A to 5D, the horizontal axis indicates the sheet thickness.

Thus, in this embodiment, to suppress the occurrence of the above-described erroneous determination, in determination of the second sheet thickness b2, a first sheet thickness range of L2 to L1 including the first sheet thickness b1 (sheet thickness range that defines the plain sheet, in this example) is adjusted in the expansion direction with at least one of an upper limit value L1 or a lower limit value L2 as a reference.

Figure 5B:
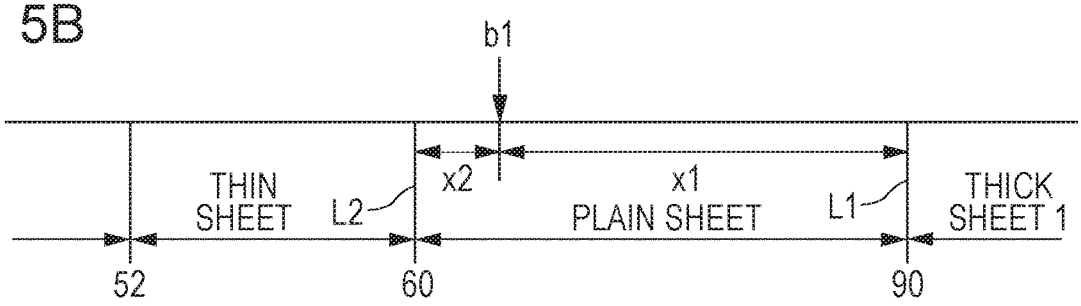
Figure 5C:
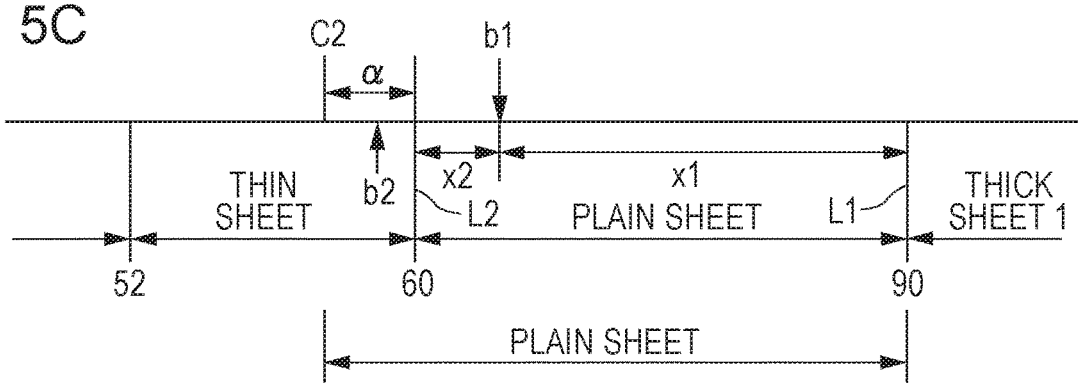

Explaining an example of the adjustment method, as illustrated in FIG. 5B, a difference x1 between the first sheet thickness b1 and the upper limit value L1 of the first sheet thickness range L2 to L1, and a difference x2 between the first sheet thickness b1 and the lower limit value L2 are calculated, and a magnitude relationship between the difference x1 and the difference x2 is further determined. In a case where the difference x1>the difference x2, in other words, in a case where the first sheet thickness b1 is close to the lower limit value L2, the lower limit value L2 side is expanded and adjusted as illustrated in FIG. 5C. In other words, with the lower limit value L2 as a reference, an adjusted lower limit value C2 is obtained by subtracting an amount of adjustment a from the lower limit value L2. Thus, the adjusted sheet thickness range is C2 to L1.

Figure 5D:
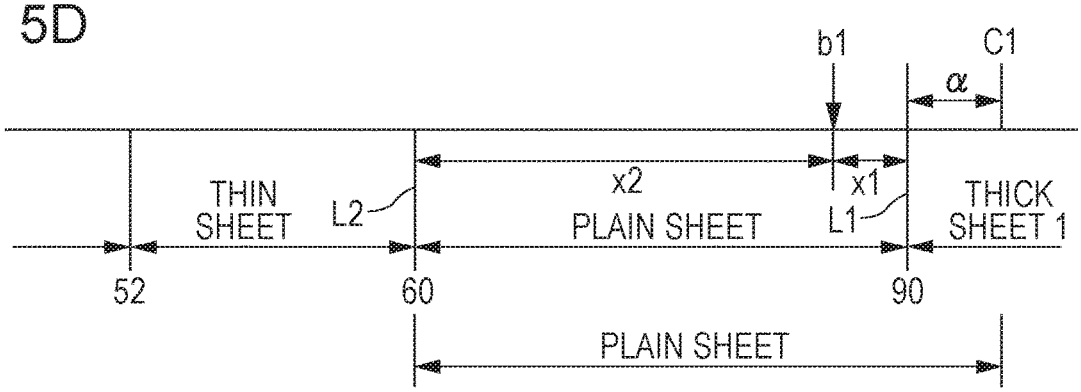

Conversely, in a case where the difference x1<the difference x2, in other words, in a case where the first sheet thickness b1 is close to the upper limit value L1, the upper limit value L side is expanded and adjusted as illustrated in FIG. 5D. In other words, with the upper limit value L1 as a reference, an adjusted upper limit value C1 is obtained by adding the a unit of adjustment a to the upper limit value L. Thus, the adjusted sheet thickness range is L2 to C1.

Furthermore, as another example of the first sheet thickness range adjustment method, a configuration may be adopted in which in a case where the difference x1 between the first sheet thickness b1 and the upper limit value L1 or the difference x2 between the first sheet thickness b1 and the lower limit value L2 is less than or equal to a predetermined value set in advance, the upper limit value L1 or the lower limit value L2 of the first sheet thickness range L2 to L1 is adjusted, and in a case where the difference x1 or the difference x2 is larger than the predetermined value, adjustment of the sheet thickness range L2 to L1 is not performed. Note that, the amount of adjustment a may be used as the predetermined value.

It is assumed that after sheet replenishment to the sheet feeding cassette 21, the second sheet thickness measurement based on the sheet thickness detection sensor 90 is performed, and the second sheet thickness b2 is measured. The image forming apparatus 1 changes the first sheet thickness range L2 to L including the first sheet thickness b1 among the sheet thickness ranges associated with the sheet type to the adjusted sheet thickness range C2 to L1, or L2 to C1, and applies the changed sheet thickness range to determine the sheet type for the second sheet thickness b2.

As described above, in a state where the first sheet thickness range L2 to L1 including the first sheet thickness b1 is expanded and adjusted, the sheet type determination for the second sheet thickness b2 is performed, so that even if the first sheet thickness b1 is, for example, 63 g/m$^2$ and is determined as the plain sheet and the second sheet thickness b2 of the sheet of the same type is 58 g/m$^2$, as illustrated in FIG. 5C, it is determined that the sheet thickness is in the sheet thickness range C2 to L1 of the plain sheet, and it is possible to prevent the sheet from being determined as the thin sheet. Furthermore, the upper limit value L1: 90 g/m$^2$ in the adjusted sheet thickness range C2 to L1 does not change, so that when the sheet of a different type is replenished and a sheet thickness exceeding the upper limit value L1 is measured, the sheet type is appropriately determined as the sheet of the different type. Thus, as compared with a case where an erroneous determination is made that the sheet type is the same sheet type even if a sheet thickness exceeding the upper limit value L1 is measured since the amount of one grid is automatically expanded as in the conventional case, the sheet thickness range can be expanded and adjusted to match the range of variations in the sheet thickness measurement values.

In this way, it is possible to suppress the occurrence of the erroneous determination that the sheet types are determined as the same even though the sheet type determined by the first sheet thickness measurement and the sheet type determined by the second sheet thickness measurement in the same job are different from each other, and it is possible to perform highly accurate sheet type determination, and it is possible to prevent problems such as a decrease in printing speed due to inappropriate image forming conditions applied due to the erroneous determination.

In the above description, the amount of adjustment a may be set to a uniform value in advance, but the magnitude of the sheet thickness measurement variation varies depending on the sheet type, and the sheet thickness is more likely to vary in the thicker sheet, so that the amount of adjustment a is desirably set for each of the sheet types. Furthermore, the amount of adjustment a may be calculated and set by referring to past sheet thickness measurement values that are actual values for sheets of the same sheet type. Specifically, the amount of adjustment a may be calculated on the basis of the maximum value and the minimum value of the past measurement values, or may be set by collecting statistics and causing the majority to be included.

FIG. 6 is a flowchart illustrating sheet type determination processing executed by the image forming apparatus 1. This processing is executed by the CPU 101 in the control unit 100 of the image forming apparatus 1 operating in accordance with the operation program recorded in a recording medium such as the ROM 102 or the storage device 110.

Furthermore, the processing is executed in a case where the sheet runs out of the sheet feeding cassette 21 or the manual sheet feeding tray 23 in the middle of one print job and the sheet is replenished in the same sheet feeding cassette 21 or the manual sheet feeding tray 23, in the job. Furthermore, even in a case where one job is a job that uses sheets from a plurality of sheet feeding trays such as a cover sheet and an interleaving sheet, the processing illustrated in the flowchart of FIG. 6 is applied for each sheet feeding cassette 21 or manual sheet feeding tray 23. Furthermore, if the sheet sizes are different from each other before and after the replenishment, there is a high possibility that the sheet types are different from each other, so that the processing is applied in a case where the sheet sizes are the same as each other. Whether or not the sheet sizes are the same as each other is determined on the basis of an output of a known sheet size detection sensor. Furthermore, in a case where the sheets of different sizes are used in one print job, the sheets of the same size are often fed from the same sheet feeding port, so that the processing illustrated in the flowchart of FIG. 6 may be applied for each sheet size.

Figure 7:
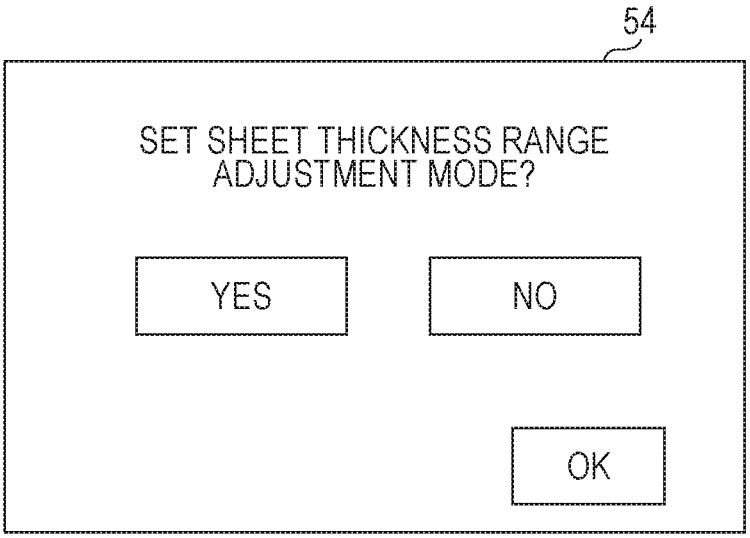
FIG. 7 is a diagram illustrating a selection screen for a sheet thickness range adjustment mode.

Furthermore, in this embodiment, the user can select whether or not to perform the sheet thickness range adjustment for the second and subsequent sheet type determinations. That is, when the user operates the operation panel unit 50 to display a selection screen for a sheet thickness range adjustment mode on the display unit 54 as illustrated in FIG. 7, "Yes" and "No" selection buttons are displayed along with a message of whether or not to set the sheet thickness range adjustment mode. When the user selects the "Yes" button and presses the "OK" button, the sheet thickness range adjustment mode is set. When the user selects the "No" button and presses the "OK" button, the sheet thickness range adjustment mode is not set and the screen returns to the previous screen. In this case, the sheet type determination after sheet replenishment is performed on the basis of the original sheet thickness range.

Returning to the flowchart of FIG. 6, sheet feeding is started in step S01, and it is determined in step S02 whether or not the sheet thickness has been measured. If the sheet thickness has not been measured (NO in step S02), the processing proceeds to step S03, and the sheet thickness is measured by using the sheet thickness detection sensor 90, and then the sheet type is determined from the measurement value and the sheet type determination table in FIG. 4 in step S04.

Next, in step SOS, it is checked whether or not a difference between the measurement value (first sheet thickness) and the upper limit value or the lower limit value of the first sheet thickness range including the sheet thickness is less than or equal to a predetermined value. If neither difference is less than or equal to the predetermined value (NO in step SOS), the processing proceeds to step S06, and it is determined to perform the next sheet type determination by applying the original unadjusted sheet thickness range, and the processing proceeds to step S10.

In step SOS, if the difference between the measurement value and the upper limit value or the lower limit value of the sheet thickness range is less than or equal to the predetermined value (YES in step SOS), it is determined in step S07 whether or not the measurement value is close to the upper limit value, in other words, whether or not the difference between the measurement value and the upper limit value is less than or equal to the predetermined value. In a case where the measurement value is close to the upper limit value (YES in step S07), it is determined in step S08 to perform the next sheet type determination by applying the sheet thickness range in which the upper limit value side is expanded, the upper limit value side of the sheet thickness range is expanded, and the processing proceeds to step S10. In step S07, in a case where the measurement value is not close to the upper limit value (NO in step S07), the measurement value is close to the lower limit value, so that it is determined in step S9 to perform the next sheet type determination by applying the sheet thickness range in which the lower limit value side is expanded, the lower limit value side of the sheet thickness range is expanded, and the processing proceeds to step S10.

As described above, the sheet thickness range adjustment for the next sheet type determination may be performed after the first sheet thickness measurement, before the second sheet thickness measurement, or may be performed after the second sheet thickness measurement as described later.

The measurement values are stored in the storage device 110 or the like in step S10, and then it is determined in step S11 whether or not there is a printing condition change. If there is no change (NO in step S11), the processing proceeds to step S13. For the first sheet of the job, the sheet type is determined from the measured sheet thickness, but the printing conditions corresponding to the sheet type are not set, so that the determination in step S11 is YES, and in step S12, the printing conditions are changed (set).

Next, printing is executed in step S13, and it is determined in step S14 whether or not a clear condition is satisfied for clearing the measurement value stored in step S10. The clear condition will be described later. If the clear condition is satisfied (YES in step S14), the measurement value is cleared in step S15. If the clear condition is not satisfied (NO in step S14), the processing returns to step S01 and sheet feeding is continued.

If the sheet thickness has been measured in step S02 (YES in step S02), it is determined in step S21 whether or not the sheet has run out and sheet replenishment has been performed. If the sheet has not run out (NO in step S21), the processing proceeds to step S13, and printing is continued until the sheet runs out.

When the sheet runs out and the sheet replenishment is performed (YES in step S21), the second sheet thickness measurement is performed in step S22. In step S23, it is determined whether or not the job for which the previous sheet thickness measurement is performed and the job for which the current sheet thickness measurement is performed are the same jobs. If the jobs are the same jobs (YES in step S23), it is checked in step S24 whether or not a difference from the previous measurement value is a small difference set in advance, and if the difference is not the small difference (NO in step S24), it is determined in step S25 whether or not the sheet thickness range has been adjusted in the previous measurement.

If the sheet thickness range has been adjusted (YES in step S25), the sheet type is determined in step S26 from the current measurement value and the adjusted sheet thickness range, and then the processing proceeds to step S10.

If the sheet thickness range has not been adjusted in step S25 (NO in step S25), the sheet thickness range is adjusted in the following procedure. First, in step S27, it is checked whether or not a difference between the previous measurement value (first sheet thickness) and the upper limit value or the lower limit value of the first sheet thickness range including the sheet thickness is less than or equal to a predetermined value. If neither difference is less than or equal to the predetermined value (NO in step S27), the processing proceeds to step S31, and the sheet type for the current measurement value is determined by applying the original unadjusted sheet thickness range, and then the processing proceeds to step S10.

In step S27, if the difference between the previous measurement value and the upper limit value or the lower limit value of the sheet thickness range is less than or equal to the predetermined value (YES in step S27), it is determined in step S28 whether or not the previous measurement value is close to the upper limit value, in other words, whether or not the difference between the previous measurement value and the upper limit value is less than or equal to the predetermined value. In a case where the previous measurement value is close to the upper limit value (YES in step S28), the current sheet type is determined in step S29 by applying the sheet thickness range in which the upper limit value side is adjusted, and then the processing proceeds to step S10. In step S28, in a case where the previous measurement value is not close to the upper limit value (NO in step S28), the measurement value is close to the lower limit value, so that the current sheet type is determined in step S30 by applying the sheet thickness range in which the lower limit value side is adjusted, and then the processing proceeds to step S10.

In step S23, in a case where the job for which the previous sheet thickness measurement is performed and the job for which the current sheet thickness measurement is performed are not the same jobs (NO in step S23), the sheet type for the current measurement value is determined in step S31 on the basis of the original sheet thickness range, and then the processing proceeds to step S10. In step S24, also in a case where the difference from the previous measurement value is the small difference set in advance (NO in step S24), there is little need to expand the sheet thickness range, so that the sheet type for the current measurement value is determined in step S31 on the basis of the original sheet thickness range, and then the processing proceeds to step S10.

In step S10, the current measurement value is overwritten on the already stored previous measurement value and stored.

Note that, when it is determined that the sheet type is different from the sheet before replenishment with respect to the current measurement value, the determination in step Si is YES, and in step S12, a change is performed to printing conditions corresponding to the sheet type newly determined, and in step S13, printing is continued under the changed printing conditions.

As described above, in a case where the second sheet thickness measurement is performed after sheet replenishment, with the measurement value (first sheet thickness) by the first sheet thickness measurement as a reference, the first sheet thickness range including the measurement value is adjusted, and the sheet type corresponding to the second measurement value is determined.

Next, the clear condition for the measurement value in step S14 will be described. Basically, when the job ends, the clear condition is satisfied, and the stored measurement value is cleared for determination of the sheet type in the next job. For example, it is determined that the clear condition is satisfied, and the stored sheet thickness is cleared at at least one of the timing when the discharge of the final sheet outside the image forming apparatus is completed in the job in which the first sheet thickness is measured, the timing when the target data of the job is deleted, or the timing when the job starts.

Alternatively, when a user who is authenticated by the authentication unit 160 and registers the job in which the first sheet thickness is measured logs out, the user's job is considered to be ended, and there is a possibility that the next user replaces the sheet with a sheet of a type suitable for a new job, so that it is determined that the clear condition is satisfied at the timing of logging out, and the clearing may be performed. Furthermore, when a user different from the user who has logged in logs in, the job is suspended, and there is a possibility that the different user replaces the sheet with a sheet of a type suitable for the different user's job, so that it is determined that the clear condition is satisfied at the timing when the different user logs in, and the clearing may be performed.

Alternatively, moreover, when an interrupt is accepted and executed in the middle of the job in which the first sheet thickness is measured, the job is suspended, and there is a possibility that a user of the interrupted job replaces the sheet with a sheet of another type, so that it is determined that the clear condition is satisfied at the timing when the interrupt is executed, and the clearing may be performed.

Note that, when the user logs out, when a user different from the user who has logged in logs in, or when there is a job interrupt, the sheet thickness measurement value for the original user's job is saved, and when the original user's job is continued, the saved measurement value may be restored to perform sheet thickness range adjustment.

In the above, the embodiment of the present invention has been described; however, the present invention is not limited to the above-described embodiment. The case has been described where, for example, the next sheet thickness measurement is performed when the sheet for the sheet feeding cassette 21 or the manual sheet feeding tray 23 is replenished; however, the timing at which the next sheet thickness measurement is performed is not limited to the sheet replenishment timing.

In a case where the sheet thickness measurement is performed for each sheet feeding, when the job is a job in which only one sheet is printed, a configuration may be adopted in which sheet thickness range adjustment processing is not performed. Furthermore, a configuration may be adopted in which although the sheet thickness measurement is performed for each feeding, when print control for the second sheet is skipped in a job that prints two sheets since the second sheet is a blank page, the sheet thickness range adjustment processing is not performed, but when the print control is executed on the second blank page, the sheet thickness range adjustment processing is performed.

In a case where sheet thickness measurement is performed three or more times in the same job since sheet replenishment is performed three or more times, or in a case where sheet thickness measurement is performed three or more times at timings other than sheet replenishment in the same job, it is only required to expand and adjust the sheet thickness range including the latest measurement value to the upper limit value side or the lower limit value side, and apply the adjusted sheet thickness range to the third and subsequent sheet type determinations. The sheet type is rarely changed in the middle of the same job, so that in the case where the sheet thickness measurement is performed three or more times, for the third and subsequent sheet thickness measurements, the second and subsequent sheet thickness determination may be performed by fixing the first sheet thickness range (for example, L2 to L1 in the example of FIG. 6) including the first sheet thickness to the adjusted sheet thickness range (for example, sheet thickness range C2 to L1 or L2 to C1 in the example of FIG. 6) of when adjustment is performed in the second sheet thickness measurement.

Figure 8A:
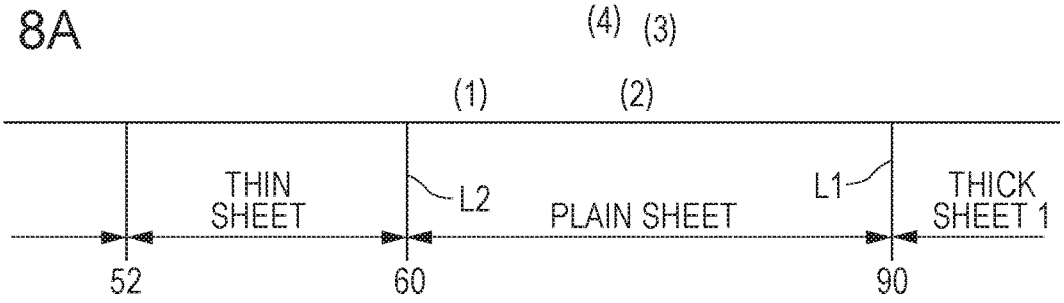
FIGS. 8A to 8D are diagrams for explaining another example of the sheet thickness range adjustment method.

Furthermore, even in a case where the second and subsequent sheet type determinations are performed by fixedly using the adjusted sheet thickness range, in a case where the second and subsequent measured sheet thicknesses are vary only in the central part of the first sheet thickness range as illustrated in FIG. 8A, there is a high possibility that the sheet of a sheet thickness that deviates from the original first sheet thickness range is different in the sheet type, so that the sheet thickness range may be returned to the original first sheet thickness range, and the first sheet thickness range may be applied to the subsequent sheet type determination. Note that, in FIGS. 8A to 8D, the circled numbers indicate the orders of the sheet thickness measurement values. FIG. 8A illustrates that the first sheet thickness is a value near the lower limit value L2 in the first sheet thickness range (L2 to L1), and the second to fourth sheet thicknesses are near the central part of the first sheet thickness range.

Whether or not sheet thicknesses vary only in the central part of the first sheet thickness range, it is only required to perform determination by counting the number of sheet thicknesses in which neither the difference from the upper limit value L1 or the lower limit value L2 of the first sheet thickness range L2 to L1 is less than or equal to a predetermined value. Specifically, when the number of sheet thicknesses in which neither the difference from the upper limit value L1 or the lower limit value L2 of the first sheet thickness range L2 to L1 is less than or equal to the predetermined value is defined as a first count value, in a case where the first count value exceeds a predetermined number, it is only required to change the adjusted sheet thickness range to the first sheet thickness range.

The case where the first count value exceeds the predetermined number may be a case where a cumulative count value exceeds the predetermined number. Alternatively, the case may be a case where when a configuration is adopted in which the first count value is cleared when a sheet thickness is measured in which the difference from the upper limit value L1 or the lower limit value L2 of the first sheet thickness range L2 to L1 is less than or equal to the predetermined value, the first count value exceeds the predetermined number, in other words, the sheet thicknesses in which neither the difference from the upper limit value L1 or the lower limit value L2 of the first sheet thickness range L2 to L1 is less than or equal to the predetermined value are continuously counted and the counted number exceeds the predetermined number.

Figure 8B:
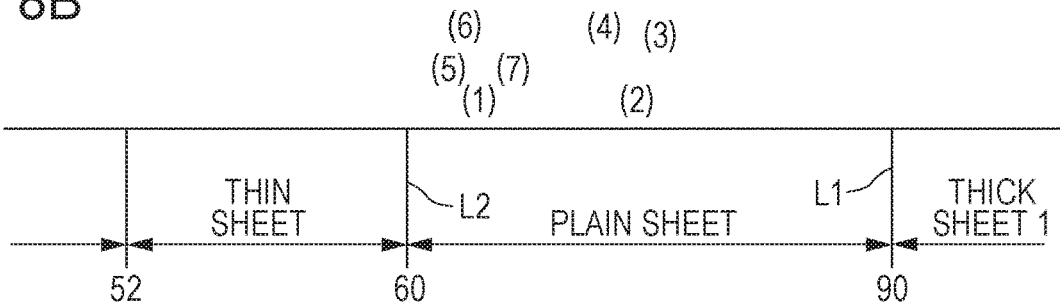

Moreover, in a case where when the sheet thickness range is returned to the first sheet thickness range and sheet type determination is performed, sheet thicknesses vary near the upper limit value L1 or the lower limit value L2 of the first sheet thickness range (L2 to L1) as illustrated in FIG. 8B (circled numbers 5 to 7 in FIG. 8B), the first sheet thickness may be changed to an adjusted sheet thickness range in which the upper limit value side or the lower limit value side is adjusted in the expansion direction, and the adjusted sheet thickness range may be applied to the subsequent sheet type determination.

Whether or not the sheet thicknesses vary near the upper limit value L1 or the lower limit value L2 of the first sheet thickness range (L2 to L1), it is only required to perform determination by counting the number of sheet thicknesses in which the difference from the upper limit value or the lower limit value of the first sheet thickness range is less than or equal to the predetermined value. Specifically, when the number of sheet thicknesses in which the difference from the upper limit value L1 or the lower limit value L2 of the first sheet thickness range L2 to L1 is less than or equal to the predetermined value is defined as a second count value, in a case where the second count value exceeds a predetermined number, it is only required to change the first sheet thickness range to the adjusted sheet thickness range.

The case where the second count value exceeds the predetermined number may be a case where a cumulative count value exceeds the predetermined number. Alternatively, the case may be a case where when a configuration is adopted in which the second count value is cleared when a sheet thickness is measured in which neither the difference from the upper limit value L1 or the lower limit value L2 of the first sheet thickness range L2 to L1 is less than or equal to the predetermined value, the second count value exceeds the predetermined number, in other words, the sheet thickness in which the difference from the upper limit value L1 or the lower limit value L2 of the first sheet thickness range L2 to L is less than or equal to the predetermined value is continuously counted and the counted number exceeds the predetermined number.

Figure 8C:
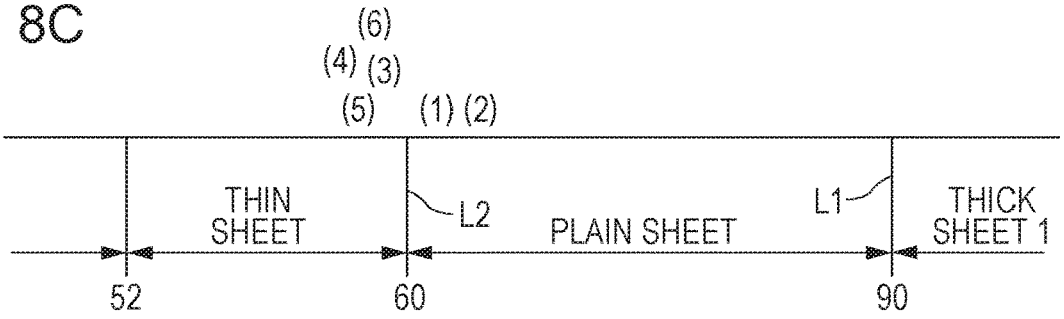

Furthermore, in a case where sheet thickness measurement is performed three or more times in the same job since sheet replenishment is performed three or more times, or in a case where sheet thickness measurement is performed three or more times at timings other than sheet replenishment in the same job, among the sheet thicknesses measured by the second and subsequent sheet thickness measurements, the number of sheet thicknesses in the first sheet thickness range L2 to L and the number of sheet thicknesses in the second sheet thickness range L3 to L2 adjacent to the first sheet thickness range are counted as illustrated in FIG. 8C, and in a case where the number of sheet thicknesses in the second sheet thickness range L3 to L2 exceeds the number of sheet thicknesses in the first sheet thickness range L2 to L by a predetermined number, the first sheet thickness range may be changed to the second sheet thickness range, and the second sheet thickness range may be applied to the subsequent sheet type determination. This is because there is a high possibility that the sheet is a sheet of a type of the second sheet thickness range L3 to L2 in this case. In particular, in a case where the remaining number of prints of the job is greater than or equal to a predetermined number of sheets when the number of sheet thicknesses in the second sheet thickness range L3 to L2 exceeds the number of sheet thicknesses in the first sheet thickness range L2 to L1 by the predetermined number, it is desirable to change the first sheet thickness range to the second sheet thickness range because chances of suppressing erroneous determination increases.

Figure 8D:
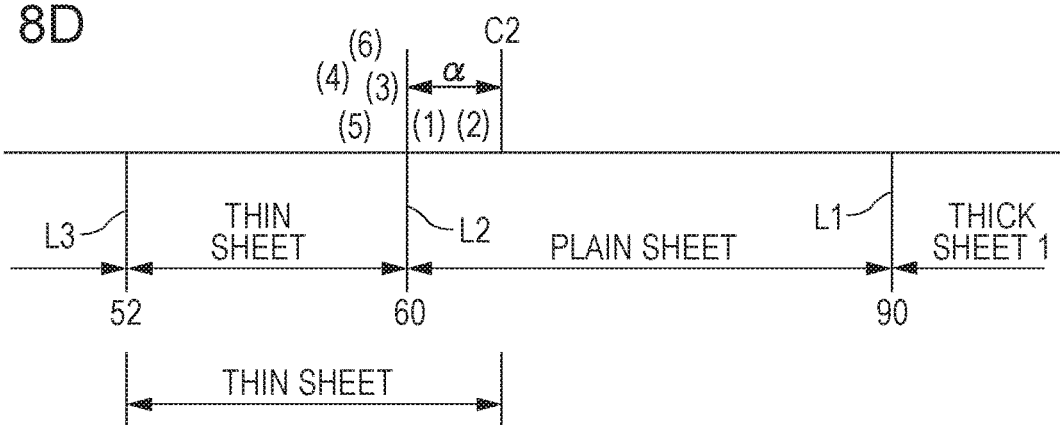
Figure 9A:
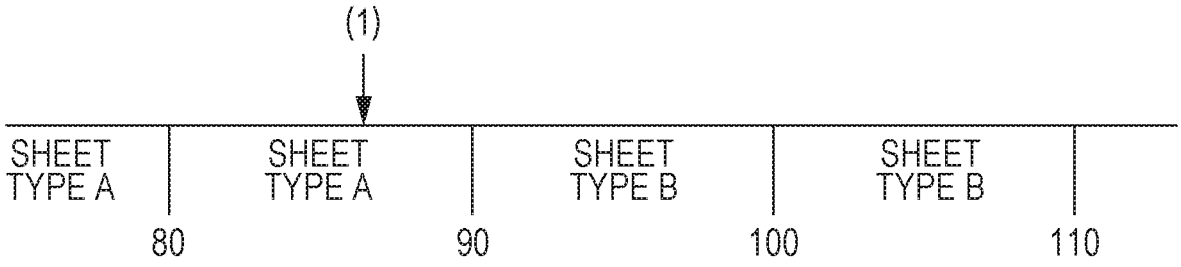
FIGS. 9A to 9C are diagrams for explaining problems of a conventional technology.
Figure 9B:
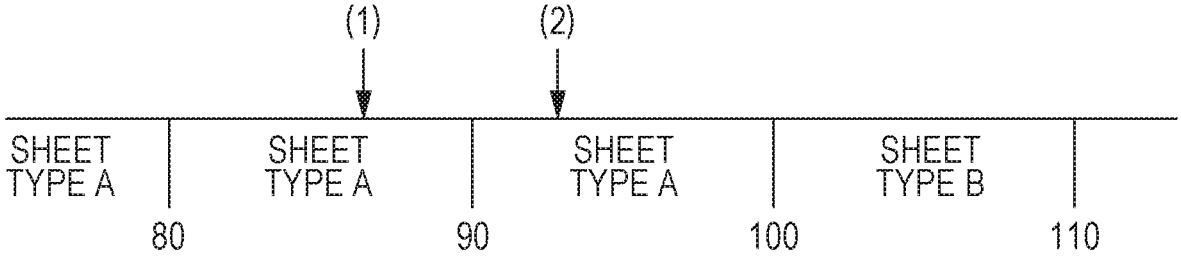
Figure 9C:
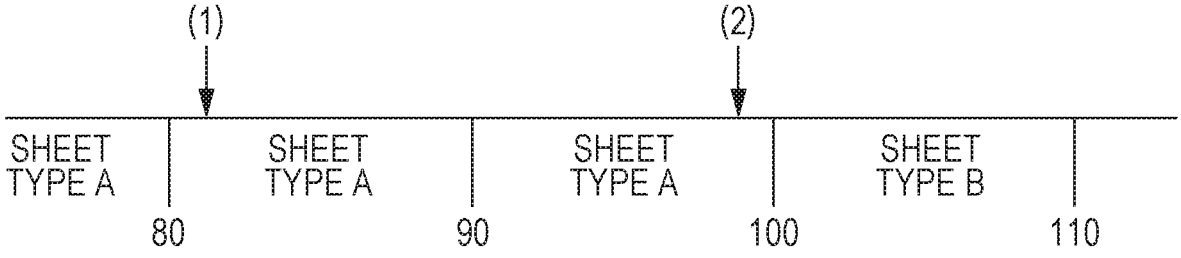

In this case, a configuration may be adopted in which the second sheet thickness range L3 to L2 changed from the first sheet thickness range L2 to L1 is expanded and adjusted to at least one of the upper limit value L2 side or the lower limit value L3 side as illustrated in FIG. 8D, and the adjusted sheet thickness range (the sheet thickness range L3 to C2 in which the upper limit value side is expanded in the example of FIG. 8D) is applied, and the sheet type is determined for the subsequent sheet thickness measurement.

According to an embodiment of the invention described in the item (1), in the case where the second sheet thickness measurement is performed after the first sheet thickness measurement in the same job, at least one of the processing of adding the predetermined amount of adjustment to the upper limit value of the first sheet thickness range including the first sheet thickness measured by the first sheet thickness measurement to obtain the adjusted upper limit value, or the processing of subtracting the predetermined amount of adjustment from the lower limit value of the first sheet thickness range to obtain the adjusted lower limit value is performed, whereby the first sheet thickness range is expanded and adjusted to at least one of the upper limit value side or the lower limit value side. Then, the type of the sheet on which the second sheet thickness measurement is performed is determined by applying the adjusted sheet thickness range instead of the first sheet thickness range.

Thus, as compared to the case where the amount of one grid is automatically expanded as in the conventional case, the upper limit value side and the lower limit value side of the first sheet thickness range are expanded and adjusted so that the sheet thickness range matches the range of variations in the sheet thickness measurement value. As a result, it is possible to suppress the occurrence of the erroneous determination that the sheet types are determined as the same even though the sheet type determined by the first sheet thickness measurement and the sheet type determined by the second sheet thickness measurement in the same job are different from each other, and it is possible to perform highly accurate sheet type determination, and it is possible to prevent problems such as a decrease in printing speed due to inappropriate image forming conditions applied due to the erroneous determination.

According to an embodiment of the invention described in the item(2), the first sheet thickness range is adjusted in the case where the difference between the first sheet thickness and the upper limit value or the lower limit value is less than or equal to the predetermined value, so that the sheet thickness range adjustment is performed only in the case where the erroneous determination of the sheet type is likely to occur. Furthermore, in the case where the difference between the first sheet thickness and the upper limit value of the first sheet thickness range is less than or equal to the predetermined value, the upper limit value side of the sheet thickness range is adjusted, and in the case where the difference between the first sheet thickness and the lower limit value of the sheet thickness range is less than or equal to the predetermined value, the lower limit value side of the sheet thickness range is adjusted, so that it is possible to expand only the side that requires range expansion among the upper limit value side and the lower limit value side of the sheet thickness range, and it is possible to enhance the certainty of the effect of suppressing the occurrence of the erroneous determination of the sheet type.

According to an embodiment of the invention described in the item (3), in the case where the difference between the first sheet thickness and the upper limit value is smaller than the difference between the first sheet thickness and the lower limit value, the upper limit value side of the first sheet thickness range is adjusted, and in the case where the difference between the first sheet thickness and the lower limit value is smaller than the difference between the first sheet thickness and the upper limit value, the lower limit value side is adjusted, so that it is possible to expand only the side that requires range expansion, and it is possible to enhance the certainty of the effect of suppressing the occurrence of the erroneous determination of the sheet type.

According to an embodiment of the invention described in the item (4), it is possible to reliably determine the sheet type on the basis of the table in which the sheet type is defined for each of the plurality of sheet thickness ranges.

According to an embodiment of the invention described in the item (5), it is possible to appropriately adjust the sheet thickness range on the basis of the amount of adjustment for each of the sheet types depending on the sheet thickness measurement variation and the like.

According to an embodiment of the invention described in the item (6), it is possible to appropriately adjust the sheet thickness range on the basis of the amount of adjustment set on the basis of the past sheet thickness measurement value.

According to an embodiment of the invention described in the item(7), the user can select whether or not to perform the sheet thickness range adjustment.

According to an embodiment of the invention described in the item(8), in the case of the job that uses the plurality of sheet feeding trays, the first sheet thickness measurement and the second sheet thickness measurement are performed for each of the sheet feeding trays.

According to an embodiment of the invention described in the item(9), the second sheet thickness measurement is performed on the sheet having the same size as the sheet on which the first sheet thickness measurement is performed.

According to an embodiment of the invention described in the item(10), the sheet type is rarely changed in the middle of the same job, so that in the case where the sheet thickness measurement is performed three or more times due to sheet replenishment to the sheet feeding tray or the like, for the third and subsequent sheet thickness measurements, the sheet type is determined on the basis of the sheet thickness range adjusted for the sheet type determination by the second sheet thickness measurement.

According to an embodiment of the invention described in the item(11), the number of sheet thicknesses is counted that have values in the first sheet thickness range and in which neither the difference from the upper limit value or the lower limit value of the first sheet thickness range is less than or equal to the predetermined value, in other words, the number of sheet thicknesses in the central part of the first sheet thickness range, among the sheet thicknesses measured by the second and subsequent sheet thickness measurements, and in the case where the number exceeds the predetermined number, it is conceivable that there is a low possibility that the measured sheet thickness deviates from the first sheet thickness range due to variations and there is little need to expand the range, so that the adjusted sheet thickness range is changed to the original unadjusted first sheet thickness range, and the first sheet thickness range is applied to the subsequent sheet type determination.

According to an embodiment of the invention described in the item (12), among the sheet thicknesses measured by the second and subsequent sheet thickness measurements, even if the number of sheet thicknesses that have values in the first sheet thickness range and in which neither the difference from the upper limit value or the lower limit value of the first sheet thickness range is less than or equal to the predetermined value is cleared when the sheet thickness is measured whose difference from at least one of the upper limit value or the lower limit value of the first sheet thickness range is less than or equal to the predetermined value, if the number of sheet thicknesses in which neither the difference from the upper limit value or the lower limit value of the first sheet thickness range is less than or equal to the predetermined value exceeds the predetermined number, the adjusted sheet thickness range is changed to the original unadjusted first sheet thickness range, and the first sheet thickness range is applied to the subsequent sheet type determination.

According to an embodiment of the invention described in the item (13), the number of sheet thicknesses is counted that have values in the first sheet thickness range and in which both the differences from the upper limit value and the lower limit value of the first sheet thickness range are less than or equal to the predetermined value, in other words, the number of sheet thicknesses close to the upper limit value or the lower limit value of the first sheet thickness range, among the sheet thicknesses measured by the second and subsequent sheet thickness measurements, and in a case where the number exceeds the predetermined number, it is conceivable that there is a possibility that the measured sheet thickness deviates from the first sheet thickness range due to variations, so that the original first sheet thickness range changed in the item (11) or (12) is again returned to the adjusted sheet thickness range, and the adjusted sheet thickness range is applied to the subsequent sheet type determination.

According to an embodiment of the invention described in the item(14), even if the number of sheet thickness measured in the item (13) is cleared when the sheet thickness is measured that has the value in the first sheet thickness range and in which the difference from at least one of the upper limit value or the lower limit value of the first sheet thickness range is not less than or equal to the predetermined value, if the number of sheet thicknesses in which both the differences from the upper limit value and the lower limit value of the first sheet thickness range are less than or equal to the predetermined value exceeds the predetermined number, the original first sheet thickness range is again returned to the adjusted sheet thickness range.

According to an embodiment of the invention described in the item(15), in the case where the third and subsequent sheet thickness measurements are further performed after the first sheet thickness measurement and the second sheet thickness measurement in the same job, the number of sheet thicknesses in the first sheet thickness range and the number of sheet thicknesses in the second sheet thickness range adjacent to the first sheet thickness range are counted, among the sheet thicknesses measured by the second and subsequent sheet thickness measurements, and in the case where the number of sheet thicknesses in the second sheet thickness range exceeds the number of sheet thicknesses in the first sheet thickness range by the predetermined number, it is preferable to apply the second sheet thickness range, so that the first sheet thickness range is changed to the second sheet thickness range, and the second sheet thickness range is applied to the subsequent sheet type determination.

According to an embodiment of the invention described in the item(16), to reduce the number of erroneous determinations as much as possible in the case where the remaining number of prints of the job is greater than or equal to the predetermined number of sheets, in other words, in a case where the number of remaining prints is large, the change to the second sheet thickness range in the item (15) is performed.

According to an embodiment of the invention described in the item (17), when the change to the second sheet thickness range is performed in the item (15) or (16), it is desirable to expand and adjust the second sheet thickness range to at least one of the upper limit value side or the lower limit value side, and apply the adjusted sheet thickness range to the sheet type determination from the viewpoint of suppressing erroneous determination.

According to the invention of the item (18), the sheet thickness stored in the storage device is cleared at at least one of the timing when the discharge of the final sheet outside the image forming apparatus is completed in the job in which the first sheet thickness is measured, the timing when the target data of the job is deleted, or the timing when the job starts.

According to an embodiment of the invention described in the item (19), the sheet thickness stored in the storage device is cleared at at least one of the timing when the user who is authenticated by the user authenticator and registers the job in which the first sheet thickness is measured logs out, or the timing when the other user different from the user who has logged in logs in.

According to an embodiment of the invention described in the item (20), the sheet thickness stored in the storage device is cleared when the interrupt is accepted and executed in the middle of the job in which the first sheet thickness is measured.

According to an embodiment of the invention described in the item (21), the sheet thickness range can be expanded and adjusted to match the range of variations in the sheet thickness measurement values, as compared with the case where the amount of one grid is automatically expanded as in the conventional case, so that it is possible to suppress the occurrence of the erroneous determination that the sheet types are determined as the same even though the sheet type determined by the first sheet thickness measurement and the sheet type determined by the second sheet thickness measurement in the same job are different from each other, and it is possible to perform highly accurate sheet type determination.

According to an embodiment of the invention described in the item(22), it is possible to cause the computer of the image forming apparatus to execute processing of adjusting the first sheet thickness range by expanding the first sheet thickness range to at least one of the upper limit value side or the lower limit value side, in the case where the second sheet thickness measurement is performed after the first sheet thickness measurement in the same job, by performing at least one of processing of adding the predetermined amount of adjustment to the upper limit value of the first sheet thickness range including the first sheet thickness measured by the first sheet thickness measurement to obtain the adjusted upper limit value, or processing of subtracting the predetermined amount of adjustment from the lower limit value of the first sheet thickness range to obtain the adjusted lower limit value, and determining the type of the sheet on which the second sheet thickness measurement is performed, by applying the adjusted sheet thickness range instead of the first sheet thickness range.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a sheet feeding tray that stores a sheet;

a sheet thickness measurement device that measures a sheet thickness of the sheet fed from the sheet feeding tray;

a hardware processor that:

determines a type of the sheet of which the sheet thickness is measured, on a basis of a plurality of sheet thickness ranges set in advance, a sheet type associated with each of the sheet thickness ranges, and the sheet thickness measured by the sheet thickness measurement device; and adjusts a first sheet thickness range by expanding the first sheet thickness range to at least one of an upper limit value side or a lower limit value side, in a case where a second sheet thickness measurement is performed by the sheet thickness measurement device after a first sheet thickness measurement by the sheet thickness measurement device in an identical job, by performing at least one of processing of adding a predetermined amount of adjustment to an upper limit value of the first sheet thickness range including a first sheet thickness measured by the first sheet thickness measurement to obtain an adjusted upper limit value, or processing of subtracting a predetermined amount of adjustment from a lower limit value of the first sheet thickness range to obtain an adjusted lower limit value; and an image former that forms an image on the sheet fed from the sheet feeding tray under image forming conditions corresponding to the sheet type determined by the hardware processor, wherein the hardware processor determines the type of the sheet on which the second sheet thickness measurement is performed, by applying an adjusted sheet thickness range by the hardware processor instead of the first sheet thickness range.

2. The image forming apparatus according to claim 1, wherein the hardware processor adjusts the first sheet thickness range in a case where a difference between the first sheet thickness and the upper limit value or the lower limit value is less than or equal to a predetermined value, and also adjusts the upper limit value side of the first sheet thickness range in a case where the difference between the first sheet thickness and the upper limit value is less than or equal to the predetermined value, and adjusts the lower limit value side of the first sheet thickness range in a case where the difference between the first sheet thickness and the lower limit value is less than or equal to the predetermined value.

3. The image forming apparatus according to claim 1, wherein the hardware processor adjusts the upper limit value side of the first sheet thickness range in a case where the difference between the first sheet thickness and the upper limit value is smaller than the difference between the first sheet thickness and the lower limit value, and adjusts the lower limit value side of the first sheet thickness range in a case where the difference between the first sheet thickness and the lower limit value is smaller than the difference between the first sheet thickness and the upper limit value.

4. The image forming apparatus according to claim 1, further comprising a table in which the sheet type is defined for each of the plurality of sheet thickness ranges, wherein the hardware processor determines the sheet type on a basis of the table.

5. The image forming apparatus according to claim 1, wherein the amount of adjustment is set for each of the sheet types.

6. The image forming apparatus according to claim 1, wherein the amount of adjustment is set on a basis of a past sheet thickness measurement value.

7. The image forming apparatus according to claim 1, further comprising a selector that allows a user to select whether or not to perform adjustment of the first sheet thickness range by the hardware processor.

8. The image forming apparatus according to claim 1, wherein in a case where the identical job is a job that uses a plurality of the sheet feeding trays, the first sheet thickness measurement and the second sheet thickness measurement by the sheet thickness measurement device are performed for each of the sheet feeding trays.

9. The image forming apparatus according to claim 1, wherein in a case where the identical job is a job that uses sheets of a plurality of sizes, the first sheet thickness measurement and the second sheet thickness measurement by the sheet thickness measurement device are performed for each of sheet sizes.

10. The image forming apparatus according to claim 1, wherein in a case where third and subsequent sheet thickness measurements are further performed by the sheet thickness measurement device after the first sheet thickness measurement and the second sheet thickness measurement in the identical job, for the third and subsequent sheet thickness measurements, the hardware processor determines the sheet type by fixedly applying the sheet thickness range adjusted by the hardware processor for sheet type determination for the second sheet thickness measurement.

11. The image forming apparatus according to claim 10, wherein the hardware processor counts a number of sheet thicknesses that have values in the first sheet thickness range and neither the difference from the upper limit value or the lower limit value of the first sheet thickness range is less than or equal to a predetermined value, among the sheet thicknesses measured by the second and subsequent sheet thickness measurements, and in a case where the number of sheet thicknesses counted by the hardware processor exceeds a predetermined number, the hardware processor changes the adjusted sheet thickness range to the first sheet thickness range, and applies the first sheet thickness range to subsequent sheet type determination.

12. The image forming apparatus according to claim 10, wherein the hardware processor counts a number of sheet thicknesses that have values in the first sheet thickness range and in which neither the difference from the upper limit value or the lower limit value of the first sheet thickness range is less than or equal to a predetermined value, among the sheet thicknesses measured by the second and subsequent sheet thickness measurements, the hardware processor clears a count value of the hardware processor when a sheet thickness is measured that has a value in the first sheet thickness range and in which the difference from at least one of the upper limit value or the lower limit value of the first sheet thickness range is less than or equal to a predetermined value, and in a case where the count value of the hardware processor exceeds a predetermined number after the count value of the hardware processor is cleared by the hardware processor, the hardware processor changes the adjusted sheet thickness range to the first sheet thickness range, and applies the first sheet thickness range to subsequent sheet type determination.

13. The image forming apparatus according to claim 11, wherein the hardware processor counts a number of sheet thicknesses that have values in the first sheet thickness range and in which the difference from the upper limit value or the lower limit value of the first sheet thickness range is less than or equal to a predetermined value, among the sheet thicknesses measured by the second and subsequent sheet thickness measurements, and in a case where the number of sheet thicknesses counted by the hardware processor exceeds a predetermined number after the change to the first sheet thickness range is applied by the hardware processor, the hardware processor again changes the first sheet thickness range to the adjusted sheet thickness range, and applies the adjusted sheet thickness range to subsequent sheet type determination.

14. The image forming apparatus according to claim 11, wherein the hardware processor counts a number of sheet thicknesses that have values in the first sheet thickness range and in which the difference from the upper limit value or the lower limit value of the first sheet thickness range is less than or equal to a predetermined value, among the sheet thicknesses measured by the second and subsequent sheet thickness measurements, the hardware processor clears a count value of the hardware processor when a sheet thickness is measured that has a value in the first sheet thickness range and in which neither the difference from the upper limit value nor the difference from the lower limit value of the first sheet thickness range is less than or equal to a predetermined value, and in a case where the count value of the hardware processor exceeds a predetermined number after the change to the first sheet thickness range is applied by the hardware processor and after the count value of hardware processor is cleared by the hardware processor, the hardware processor again changes the first sheet thickness range to the adjusted sheet thickness range, and applies the adjusted sheet thickness range to subsequent sheet type determination.

15. The image forming apparatus according to claim 1, wherein the hardware processor counts a number of sheet thicknesses in the first sheet thickness range and a number of sheet thicknesses in a second sheet thickness range adjacent to the first sheet thickness range, among the sheet thicknesses measured by the second and subsequent sheet thickness measurements, in a case where third and subsequent sheet thickness measurements are further performed by the sheet thickness measurement device after the first sheet thickness measurement and the second sheet thickness measurement in the identical job, and in a case where the number of sheet thicknesses in the second sheet thickness range counted by the hardware processor exceeds the number of sheet thicknesses in the first sheet thickness range by a predetermined number, the hardware processor changes the first sheet thickness range to the second sheet thickness range, and applies the second sheet thickness range to subsequent sheet type determination.

16. The image forming apparatus according to claim 15, wherein in a case where a remaining number of prints of the job is greater than or equal to a predetermined number of sheets when the number of sheet thicknesses in the second sheet thickness range counted by the hardware processor exceeds the number of sheet thicknesses in the first sheet thickness range by the predetermined number, the hardware processor changes the first sheet thickness range to the second sheet thickness range and applies the second sheet thickness range.

17. The image forming apparatus according to claim 15, wherein the hardware processor adjusts the second sheet thickness range changed from the first sheet thickness range by expanding the range to at least one of the upper limit value side or the lower limit value side, and the hardware processor determines the sheet type for subsequent sheet thickness measurement by applying the adjusted sheet thickness range.

18. The image forming apparatus according to claim 1, further comprising a storage device that stores the sheet thickness measured by the sheet thickness measurement device, wherein the hardware processor clears the sheet thickness stored in the storage device, and the hardware processor clears the sheet thickness stored in the storage device at at least one of a timing when discharge of a final sheet outside the image forming apparatus is completed in the job in which the first sheet thickness is measured, a timing when target data of the job is deleted, or a timing when the job starts.

19. The image forming apparatus according to claim 1, further comprising a storage device that stores the sheet thickness measured by the sheet thickness measurement device, and a user authenticator, wherein the hardware processor clears the sheet thickness stored in the storage device, and the hardware processor clears the sheet thickness stored in the storage device at at least one of a timing when a user who is authenticated by the user authenticator and registers the job in which the first sheet thickness is measured logs out, or a timing when another user different from the user who has logged in logs in.

20. The image forming apparatus according to claim 1, further comprising a storage device that stores the sheet thickness measured by the sheet thickness measurement device, wherein the hardware processor clears the sheet thickness stored in the storage device, and accepts and executes an interrupt, and the hardware processor clears the sheet thickness stored in the storage device when the interrupt is accepted and executed by the hardware processor in a middle of the job in which the first sheet thickness is measured.

21. A sheet type determination method in an image forming apparatus, comprising:

measuring a sheet thickness of a sheet fed from a sheet feeding tray that stores the sheet;

determining a type of the sheet of which the sheet thickness is measured, on a basis of a plurality of sheet thickness ranges set in advance, a sheet type associated with each of the sheet thickness ranges, and the sheet thickness measured by the measuring;

forming an image on the sheet fed from the sheet feeding tray under image forming conditions corresponding to the sheet type determined by the determining;

adjusting a first sheet thickness range by expanding the first sheet thickness range to at least one of an upper limit value side or a lower limit value side, in a case where a second sheet thickness measurement is performed by the measuring after a first sheet thickness measurement by the measuring in an identical job, by performing at least one of processing of adding a predetermined amount of adjustment to an upper limit value of the first sheet thickness range including a first sheet thickness measured by the first sheet thickness measurement to obtain an adjusted upper limit value, or processing of subtracting a predetermined amount of adjustment from a lower limit value of the first sheet thickness range to obtain an adjusted lower limit value, wherein in the determining, the type of the sheet on which the second sheet thickness measurement is performed is determined by applying the adjusted sheet thickness range by the adjusting instead of the first sheet thickness range.

22. A non-transitory recording medium storing a computer readable program causing a computer to execute:

measuring a sheet thickness of a sheet fed from a sheet feeding tray that stores the sheet;

determining a type of the sheet of which the sheet thickness is measured, on a basis of a plurality of sheet thickness ranges set in advance, a sheet type associated with each of the sheet thickness ranges, and the sheet thickness measured by the measuring;

forming an image on the sheet fed from the sheet feeding tray under image forming conditions corresponding to the sheet type determined by the determining;

adjusting a first sheet thickness range by expanding the first sheet thickness range to at least one of an upper limit value side or a lower limit value side, in a case where a second sheet thickness measurement is performed by the measuring after a first sheet thickness measurement by the measuring in an identical job, by performing at least one of processing of adding a predetermined amount of adjustment to an upper limit value of the first sheet thickness range including a first sheet thickness measured by the first sheet thickness measurement to obtain an adjusted upper limit value, or processing of subtracting a predetermined amount of adjustment from a lower limit value of the first sheet thickness range to obtain an adjusted lower limit value, wherein in the determining, the computer is caused to execute processing of determining the type of the sheet on which the second sheet thickness measurement is performed, by applying the adjusted sheet thickness range by the adjusting instead of the first sheet thickness range.

* * * * *